US007924124B2

(12) United States Patent
Leipold et al.

(10) Patent No.: US 7,924,124 B2
(45) Date of Patent: Apr. 12, 2011

(54) ELECTRICAL SWITCHING DEVICE COMPRISING MAGNETIC DISPLACEMENT ELEMENTS FOR A SWITCHING ELEMENT

(75) Inventors: Markus Leipold, Isen (DE); Helmut Hingrainer, Raubling (DE); Alexander Bayer, München (DE)

(73) Assignee: Rohde & Schwarz GmbH & Co. KG, München (DE)

( * ) Notice: Subject to any disclaimer, the term of this patent is extended or adjusted under 35 U.S.C. 154(b) by 509 days.

(21) Appl. No.: 11/916,406

(22) PCT Filed: Jun. 19, 2006

(86) PCT No.: PCT/EP2006/005864

§ 371 (c)(1),
(2), (4) Date: Feb. 25, 2008

(87) PCT Pub. No.: WO2007/000258

PCT Pub. Date: Jan. 4, 2007

(65) Prior Publication Data

US 2009/0015358 A1 Jan. 15, 2009

(30) Foreign Application Priority Data

Jun. 28, 2005 (DE) ..... 10 2005 030 106
Jan. 13, 2006 (DE) ..... 10 2006 001 841

(51) Int. Cl.

| | |
|---|---|
| ***H01H 9/00*** | (2006.01) |
| ***H01H 67/00*** | (2006.01) |
| ***H01H 1/66*** | (2006.01) |
| ***H01H 51/00*** | (2006.01) |
| ***H01H 7/16*** | (2006.01) |
| ***H01H 9/20*** | (2006.01) |

(52) U.S. Cl. ..... 335/177; 335/106; 335/107; 335/151; 335/152; 335/153; 335/154; 335/167; 335/170; 335/178; 335/179; 335/192; 335/205; 335/206; 335/207

(58) Field of Classification Search ..... 335/4–5, 335/68–72, 78–79, 106–115, 151–154, 167–171, 335/177–179, 192, 205–207; 200/181, 1 R; 333/101, 105, 22 R; 385/20, 22
See application file for complete search history.

(56) References Cited

U.S. PATENT DOCUMENTS

| | | | | |
|---|---|---|---|---|
| 2,521,723 | A * | 9/1950 | Hubbell | 335/207 |
| 3,051,805 | A * | 8/1962 | Binford | 335/48 |
| 3,260,821 | A * | 7/1966 | Yokoo | 335/207 |
| 3,320,562 | A * | 5/1967 | Germanton | 335/207 |

(Continued)

FOREIGN PATENT DOCUMENTS

DE 4011977 0/1991

(Continued)

OTHER PUBLICATIONS

International Search Report for PCT/EP2006/005864 dated Sep. 6, 2006.

*Primary Examiner* — Elvin G Enad
*Assistant Examiner* — Mohamad A Musleh
(74) *Attorney, Agent, or Firm* — Marshall, Gerstein & Borun LLP

(57) ABSTRACT

Electrical switching device, especially a high-frequency switching device, with at least one oblong electrical switching element, which is arranged with one contact end between two fixed-contact elements spaced a transverse distance from one another and can be moved by two adjustment elements forming a transverse movement drive transversely to a longitudinal direction optionally towards the one or the other fixed-contact element. The adjustment elements are disposed laterally alongside the switching element and can be moved transversely to and from the switching element. In order to improve the transverse movement drive for the switching element, the switching element-comprises magnetic material, wherein the adjustment elements are formed by magnets.

23 Claims, 6 Drawing Sheets

U.S. PATENT DOCUMENTS

| | | | | |
|---|---|---|---|---|
| 3,448,419 | A * | 6/1969 | Myatt | 335/206 |
| 3,449,700 | A * | 6/1969 | Gillilan | 335/188 |
| 3,458,839 | A * | 7/1969 | Heetman | 335/152 |
| 4,039,985 | A | 8/1977 | Shlesinger, Jr. et al. | |
| 4,041,427 | A * | 8/1977 | Chusha | 335/205 |
| 4,965,542 | A | 10/1990 | Nelson | |
| 5,499,006 | A * | 3/1996 | Engel et al. | 335/4 |
| 6,246,307 | B1 * | 6/2001 | Friedman | 335/205 |
| 6,650,210 | B1 * | 11/2003 | Raklyar et al. | 335/4 |
| 2008/0129425 | A1 * | 6/2008 | Leipold et al. | 333/259 |

FOREIGN PATENT DOCUMENTS

| | | |
|---|---|---|
| DE | 1169559 | 5/1964 |
| DE | 2304775 | 8/1974 |
| DE | 2716257 | 10/1978 |
| DE | 7821797 | 10/1978 |
| DE | 9409770 | 10/1995 |
| DE | 10103814 | 8/2002 |
| EP | 1111640 | 6/2001 |

* cited by examiner

ELECTRICAL SWITCHING DEVICE COMPRISING MAGNETIC DISPLACEMENT ELEMENTS FOR A SWITCHING ELEMENT

BACKGROUND OF THE INVENTION

1. Field of the Invention

The invention relates to an electrical switching device, preferably a high-frequency switching device.

2. Related Technology

A switching device of this kind is described in DE 101 03 814 A1. This switching device is used in particular for switching a current conduction for a high-frequency calibration line through various attenuation elements. For this purpose, it provides an oblong and preferably-flat switching element, which can be moved transversely to its longitudinal direction by an adjustment element. In this context, a contact surface at its one end is brought optionally into contact or out of contact with a fixed-contact surface. In the contact position, the conduction of electrical current to the contact surfaces is dependent, among other factors, upon the mutual disposition of the contact surfaces and the fixed-contact surfaces. Contamination or particles can substantially impair the current conduction, especially if the contamination and/or particles consist of electrically non-conductive material.

An interference-free current conduction is particularly important in the case of calibration lines, which are used as a reference for attenuation adjustments, for example, of signal generators or network analysers. Calibration lines provide, for example, several four-pole switching devices arranged in series with equal and constant surge impedance at the input-end and output-end and, in each case, with adjustable, calibrated attenuation and therefore also with a precise level.

In the case of the known high-frequency electrical switching devices, as they are typically used, for example, in high-frequency calibration lines, the lateral switching movement of a switching element through an application of an external mechanical force is achieved by plungers, which press laterally against the switching element thereby moving the latter. As a result of the lateral, rotary movement, carried out by the switching element and the linear pushing movements of the plungers provided on both sides of the switching element, sliding movements occur in the contact region of the plungers and the switching element. These movements cause abrasion as a result of the associated friction. In particular, if the switching device provides an enclosed switching chamber, the risk of a contact impairment resulting from the abrasion caused by the friction is particularly great, because the abraded particles remain in the switching chamber. But even in the case of an open switching chamber, there is also a risk that the abraded particles could enter between the contact surfaces and impair the electrical contact. Moreover, the plungers can have a negative influence on the high-frequency behavior.

GENERAL DESCRIPTION OF THE INVENTION

The invention improves the transverse movement drive for the switching element in an electrical switching device of the type presented above. Furthermore, friction processes and the resulting risk of an impairment of the electrical contact through abraded particles should be removed or at least reduced. In particular, the occurrence of abrasion in the environment of the contact surfaces should be avoided or at least reduced. Furthermore, a contactless transverse movement of the switching element should be possible, preferably in an enclosed, in particular, a hermetically-closed or sealed housing. A simple design should also be provided.

This object is achieved by the features of claim 1. Advantageous further developments of the invention are described in the dependent claims. The invention provides an electrical switching device, especially a high-frequency switching device, with at least one oblong electrical switching element, which is disposed with one contact end between two fixed-contact elements transversely spaced from each other, and which can be moved by two adjustment elements transversely to a longitudinal direction optionally toward the one or the other fixed-contact element, wherein the adjustment elements are arranged laterally alongside the switching element and can be moved transversely to and from the switching element, wherein the switching element comprises magnetic material and the adjustment elements are formed by magnets.

With a switching-movement drive of the switching element based on magnetic forces, no mechanical contact of the movement drive is required between the switching element and the adjustment elements; accordingly, in the case of switching movements of the switching element achieved by magnetic forces, no mechanical contact is present, and sliding friction does not therefore occur between the latter, and no associated abraded particles are caused.

Moreover, the efficacy of the magnetic force of a magnet is variable dependent upon the magnitude of the distance between the magnet and an element subject to the magnetic force and decreases as the distance increases and increases as the distance the decreases.

With the switching device according to the invention, the switching element comprises magnetic material, and the adjustment elements are formed respectively by at least one magnet. As a result, the magnetic force of each magnet acting on the switching element can be increased by moving it forward towards the switching element so far that it exceeds the magnetic force of the other magnet disposed opposite and acting on the switching element, and draws the switching element out of the range of magnetic attraction of the magnet disposed opposite and towards the magnet moved forward and accordingly moves the switching element towards the associated fixed-contact element.

A corresponding switching function is achieved, if the other magnet disposed opposite is moved forward towards the switching element.

In both of the above cases of switching, the magnetic force acting on the switching element of the magnet not moved forward can be reduced by increasing the distance between the latter and the switching element. As a result, the efficacy of the magnetic force of the magnet moved forward is increased, and the switching of the switching element to the associated fixed-contact element is reinforced.

As a result, the switching function can be further improved and/or simplified, if the magnet not moved forward is at the same time moved transversely away or back from the switching element, wherein its magnetic force acting on the switching element is reduced, thereby increasing the efficacy of the magnetic force of the magnet moved forward. It is therefore advantageous to move both mutually-opposite magnets at the same time in the same transverse direction, which increases the efficacy of the magnetic force of the adjustment magnet moved towards the switching element and reduces the efficacy of the magnet moved away from the switching element. A movement drive of this kind for the magnets can therefore be simply designed by connecting the magnets to one another by a coupling element or by placing the magnets on a common slider, which can be moved transversely.

In the event of a switching process, one of the two magnets therefore performs the switching function through its forward movement, that is to say, the movement of the switching element towards the respective fixed-contact element and the contact holding function against the fixed-contact element; the efficacy of the magnet, which is disposed opposite to the contacting fixed-contact element, is reduced or cancelled by its respective movement away or backwards.

The switching device according to the invention provides contactless switching. In the movement of the switching element towards the fixed-contact element, there is therefore no mechanical sliding friction; nor does this cause the associated abraded particles, so that the electrical contact remains unimpaired in this respect.

The invention is characterized respectively by a simple design, which can be realized on a small-scale, because it requires no mechanical connection between the switching element and the magnets. In view of the lack of mechanical connection, the embodiments according to the invention are variable and adaptable with reference to the distances between the switching element and the adjustment elements, so that it can be integrated into existing designs in a simple and advantageous manner.

It contributes to a substantial simplification of the switching device, if the respective magnets are formed by a permanent magnet.

The embodiments according to the invention are also very advantageously suitable in combination with a switching element in the shape of a plate spring, of which the broad sides face towards the respectively-associated magnet. In this context, the switching element can have the dimensions of a thin film, so that the switching element can be moved in the direction towards the respectively-opposite fixed-contact element and held in the contact position with small motive forces.

In this context, the switching element does not have to be moved directly towards the respectively-associated magnet. The contact-holding function is also guaranteed with a sufficient magnetic force of the magnet, if a sufficient distance is present between the switching element and the magnet in the contact position.

The embodiment according to the invention is also preferably suitable for a switching device, in which the switching elements are disposed in a preferably-sealed protective chamber of a housing, wherein through-passages for mechanical adjustment elements are not required.

Furthermore, it contributes to a simple, compact and cost-favourable design, if two switching elements are disposed with their mutually-facing contact ends at a longitudinal distance opposite from one another with regard to a transverse plane and can be moved transversely towards a fixed-contact element, for example, a common fixed-contact element.

In this context, a common magnet overlapping the mutually-adjacent contact ends of the two switching elements can be disposed on each side for the movement of both switching elements, being mounted so that it can be moved transversely to and fro. As a result, a four-pole switching device can be realized in a simple manner with only two magnets.

For an adjustment function and/or switching function according to the invention, it is sufficient if two magnets are disposed opposite to one another on both sides of the switching elements. In order to increase the magnetic forces acting on the switching element, it is advantageous to arrange several magnets on both sides of the switching element, especially, an adjustment-magnet pair in each case, wherein the mutually-opposing magnets of each pair must be of the same polarity. In this context, the two magnets of each pair can provide a distance from one another, which, with reference to a central plane of movement of the switching element, is preferably approximately the same as or greater than the width of the preferably flat, tongue-shaped switching element.

In one further development of the invention with several magnets on each side of the switching element, it is advantageous for the purpose of simplification of the design, to connect all of the magnets to one another by means of a coupling element or to arrange them on a common slider, so that the magnets form a movement unit.

Moreover, it is advantageous to allocate a preferably-common movement drive to the magnet or magnets or magnet pairs, preferably with an electrical drive motor in each case. The switching functions can be mechanized accordingly by means of an associated control device. An electromagnet, which brings about the required movement of the respective at least one magnet or of a movement unit comprising several magnets by means of magnetic forces, is particularly advantageous as the electrical drive motor. With a magnetic drive of this kind, attractive and repulsive magnetic forces can also be generated using a corresponding polar arrangement or polar switching, wherein two electromagnets can generate the respective drive movement at the same time with an amplification or respectively doubting of the drive forces.

Further developments of the invention provide simple design and attachment features, which guarantee a compact and durable design with a secure and interference-free function and electrical contact.

BRIEF DESCRIPTION OF THE DRAWING

Advantageous embodiments of the invention are described in greater detail below on the basis of several exemplary embodiments and drawings. The drawings are as follows.

DETAILED DESCRIPTION

Figure 1:
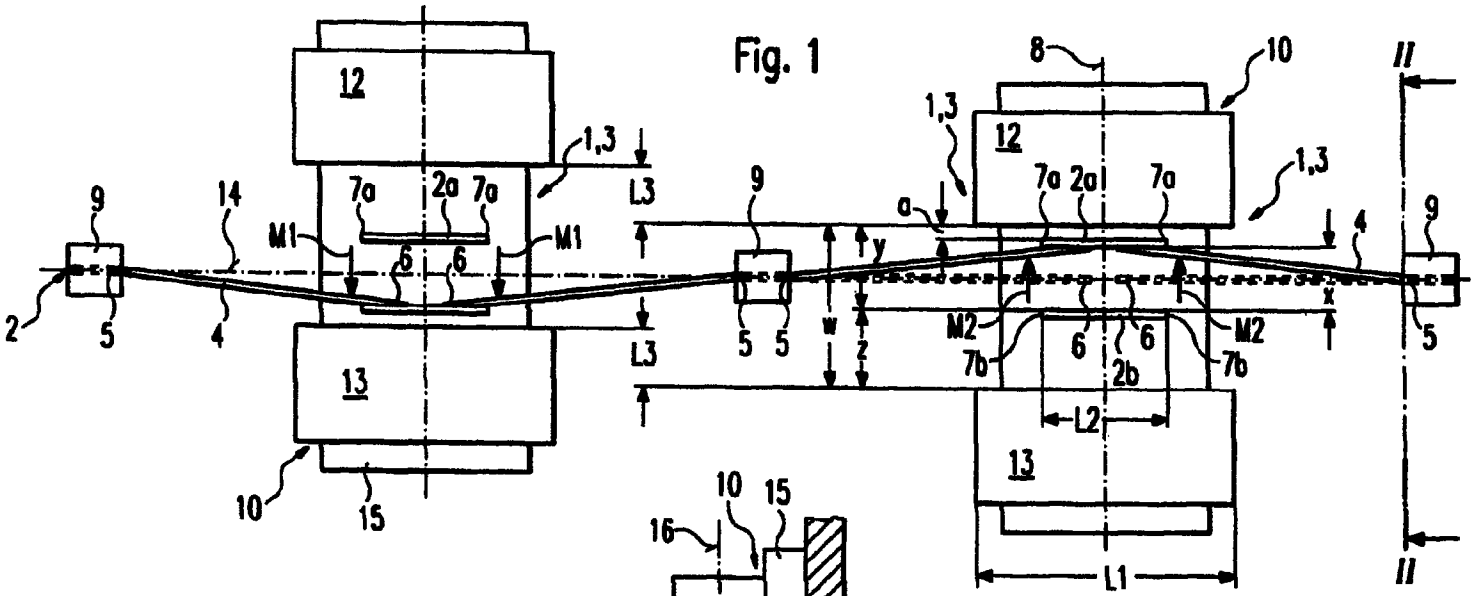
FIG. 1 shows a schematic presentation of several electrical switching devices according to the invention arranged in series, in each case in a switching position.

The drawings show several switching devices designated generally by reference number 1, of which the portions of conductor, which can be electrically connected to one another, form the longitudinal portions of an electrical line 2 and provide respectively a switch 3 with a switching element 4, which can be moved transversely to and fro relative to the electrical line 2 and which is used to connect or disconnect the line 2. The switching element 4 is an oblong element, which is connected permanently to the line 2 at its base end 5 and provides a contact end 6 at its other end, with which, after a transverse movement into its contact position, it contacts one of two fixed-contact elements 7*a*, 7*b* disposed at a fixed transverse distance from one another. An open position, in which the contact end 6 provides a lateral distance from the fixed-contact elements 7*a*, 7*b*, can be provided in the mid-position indicated by sketched lines.

Figure 2:
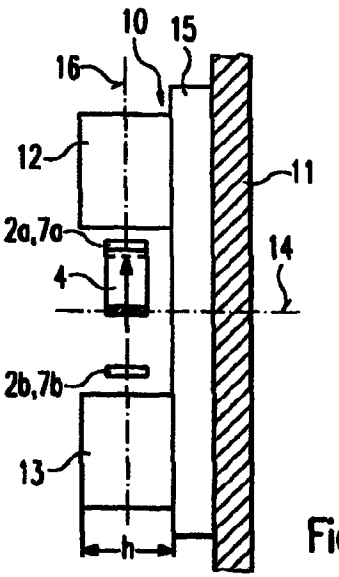
FIG. 2 shows a switching device in the section II-II from FIG. 1.

The fixed-contact elements 7*a*, 7*b* are held in a rigid manner, for example, on the base 11, which is shown only in FIG. 2, and can be formed by the ends of line portions, which are formed, for example, by flat strips arranged on edge.

In the exemplary embodiment, the at least one switching device 1 is part of a so-called calibration line with switchable calibration portions 2*a*, 2*b* arranged in parallel, which are connected to the fixed-contact elements 7*a*, 7*b* and can be switched as required, wherein at least one calibration-line portion is attenuated and forms an attenuation line.

FIG. 1 shows at the left and right respectively a four-pole calibration line formed respectively by four switches 3 with two calibration-line portions 2*a*, 2*b* and two preferably identically-formed switching elements 4, which are arranged in mirror image to one another on both sides of a transverse plane 8 extending transversely to the electrical line 2 and approximately centrally between the fixed-contact elements 7*a*, 7*b*, so that their contact ends 6 face towards one another, which are arranged in each case between two laterally-spaced, fixed-contact elements 7*a*, 7*b* and can be moved optionally towards the one or other fixed-contact element 7*a*, 7*b*. Since the switching devices 1 arranged in mirror image on both sides of the transverse plane 8 are substantially identical, only one of the two switching devices 1 disposed to the left of the transverse plane 8 will be described below.

The switching element 4 is preferably capable of resilient lateral bending, wherein its base end 5 is held in a holder 9, which is attached to a first base 11 illustrated in FIG. 2. A resilient tongue in the form of a flat strip, shown in plan view in FIG. 1, so that its narrow side is visible and its two mutually-opposite broad sides face towards the fixed-contact element 7*a*, 7*b*, is particularly suitable as a resilient switching element 4. The flat strip can also be formed by a thin foil, of which the thickness can be, for example, less than approximately 1/10 mm and only a few μm.

According to a first exemplary embodiment of the invention, in order to implement a switching process, in which the switching element 4 is moved laterally towards the one or the other fixed-contact element 7*a*, 7*b*, a first adjustment magnet or switching magnet 12, 13, which is mounted in a transversely-displaceable manner in a transversely-extending, respectively-associated guide 14 and can therefore be moved in the direction towards the switching element 4 and back again, is arranged on each side of the switching element 4. As shown in FIG. 2, the magnets 12, 13 are arranged centrally on both sides with reference to the central rotational plane 16 of the switching element or switching elements 4, so that the central axes intersecting the polar axes of the magnets 12, 13 are disposed in the central rotational plane 16.

The magnets 12, 13 are preferably arranged behind the fixed-contact elements 7*a*, 7*b*, wherein they can provide a transverse distance a from the latter. The height h of the magnets 12, 13 extending transversely to the rotational plane 16 of the switching element or switching elements 4 is greater than the width c of the switching element or switching elements 4, so that, with a preferable mid-height arrangement, the magnets 12, 13 project beyond both narrow sides of the adjustment element or adjustment elements 4 see FIG. 2.

The magnets 12, 13 are preferably jointly-adjustable as a movement unit 10. For this purpose, they can be connected by a coupling element. As clearly illustrated in the exemplary embodiment shown in FIGS. 1 and 2, the magnets 12, 13 are arranged on a transversely-extending slider 15, which is mounted in a transversely-displaceable manner in the guide 14 and forms a movement unit with the magnets 12, 13. The guide 14 can be disposed on or over the first base 11.

The magnets 12, 13 are arranged substantially centrally with reference to the transverse plane 8, wherein their length L1 extending in the longitudinal direction of the line 2 is sufficiently large, that it overlaps the sufficiently-long end portions of the mutually-facing switching elements 4. In this context, it is advantageous, that the magnets 12, 13 also project beyond the fixed-contact elements 7*a*, 7*b*, as shown in the exemplary embodiments. The length of the fixed-contact elements 7*a*, 7*b* is shown by the reference number L2.

In FIG. 1, the switching devices 1 arranged on the right-hand side of the drawing show the common magnet 12 in its most forward position moved towards the switching elements 4, in which the magnet 12 is disposed in contact with the fixed-contact element 7*a* or can provide a transverse distance from the latter. The magnet 13 disposed respectively opposite is arranged in its most remote position from the fixed-contact elements 7*b*.

The magnetic force of the magnets 12, 13, which is substantially of an equal magnitude in the exemplary embodiments, is respectively sufficiently large that, taking into consideration the lateral distance of the respective magnets 12, 13, at least in the position closest to the switching elements 4 (pushed forward), the switching elements 4 are attracted by the magnetic force M1 of the nearest magnet 12, 13, drawn towards the fixed-contact element 7*a* and held in this contact position.

In this context, it must be taken into consideration that with a respective forward movement of the one magnet 12, 13, which is supposed to bring about a switching process, the magnetic force M1 of the other magnet acting on the switching element 4, draws the switching element or switching elements 4 towards this magnet and holds it on the associated fixed-contact element. In this context, it must also be taken into consideration, that during the forward movement of the one magnet 12, 13, the other magnet 12, 13 is moved away from the at least one switching element 4, because the switching element cannot follow the other magnet because of its contact position on the fixed-contact element 7*a*, 7*b* and accordingly, the magnetic force M1 of the other magnet acting on the switching element 4 decreases with an increasing movement away, which increases the effective magnetic force M1 of the one magnet 12, 13.

The distance w between the magnets 12, 13, the distance x between the fixed-contact elements 7*a*, 7*b* and the transverse movement or stroke length L3 of the magnets 12, 13 or respectively of the movement unit 10 are selected to be so large, that in the end-of-stroke position of the magnet 12, 13 moved forward, the distance y relative to the facing surface of the fixed-contact element 7*a*, 7*b* arranged further away from the latter is smaller than the distance z of the retracted magnet 12, 13 from the surface of this fixed-contact element 7*a*, 7*b* facing away from the latter. The respectively shorter distance y by comparison with the relatively longer distance z accordingly guarantees that the magnetic force M1 acting on the contact element 4 of the magnet 12, 13 moved forward is greater than the magnetic force M1 acting on the switching element or switching elements 4 of the magnet 12, 13 moved backwards, and therefore, the switching of the switching element or switching elements 4 is implemented towards the magnets 12, 13 moved forward and towards the associated fixed-contact element 7*b*. If the switching element 4 provides a restoring force, the distance y can also be selected to be greater than the distance z, provided the sum of the restoring force and the magnetic force M1 of the magnet moved forward is greater than the magnetic force M1 of the magnet moved backwards.

In order to switch the switching elements 4 towards the fixed-contact elements 7*b* into a switching position as shown in FIG. 1 on the right, the magnet 13, as shown in FIG. 1 on the left is moved forward in the direction towards the switching elements 4, wherein the magnet 12 is moved backwards at the same time and, in this context, the magnetic force M1 of the magnet 13 acting on the switching elements 4 attains a magnitude, which is sufficient to attract the switching elements 4 towards the magnet 13 and towards the fixed-contact elements 7*b*.

Figure 3:
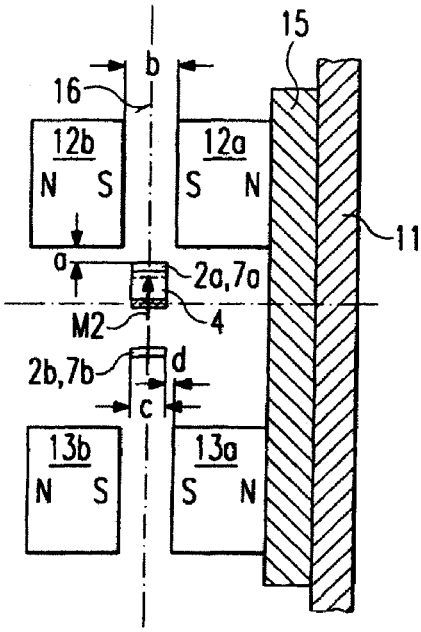
FIG. 3 shows a modified embodiment of a switching device according to the invention in the section II-II from FIG. 1.

In order to increase the magnetic forces acting on the switching elements 4, several, for example, two adjustment magnets 12*a*, 12*b* or respectively 13*a*, 13*b* can be arranged on each side of the switching elements 4. In the case of the exemplary embodiment shown in FIG. 3 and the subsequent drawings, in which identical or comparable components are marked with the same reference numbers, two adjustment magnets 12*a*, 12*b* or respectively 13*a*, 13*b* are arranged, on both sides of the central rotational plane 16 of the switching elements 4, for example, symmetrically to the latter, wherein the adjustment magnets 12*a*, 12*b* and 13*a*, 13*b* disposed respectively on one side face one another with the same poles, for example, as shown in the exemplary embodiments, with their south poles S. The distance b between the adjustment magnets arranged respectively on one side of a magnet pair is approximately equal to or greater than the width c of the switching elements 4, which are preferably designed in a mutually-identical manner. With the arrangement of magnet pairs, a common magnetic force M2 arises within the rotational range of the switching elements 4, which is a resulting magnetic force of two adjustment magnets 12*a*, 12*b* and respectively 13*a*, 13*b*, of which the magnetic field lines, which are not illustrated, are bundled within the range of the distance b.

Although in each case, the magnet pair 12*a*, 12*b* is arranged relative to the transverse axis 8 behind the fixed-contact elements 7*a*, 7*b*, it is advantageous in order to guarantee a good characteristic of the magnetic lines of force, to arrange the magnets 12*a*, 12*b* of this magnet pair at a distance b, which is equal to or greater than the width c of the switching element or switching elements 4. This provides a distance d between the mutually-facing sides of the magnets and a plane containing the narrow sides of the switching element or switching elements 4.

With the exemplary embodiments with adjustment-magnet pairs also, the adjustment magnets 12*a*, 12*b*, 13*a*, 13*b* are connected to one another to form a common movement element. This is not shown in FIGS. 3 and 4 with regard to the adjustment magnets 12*b* and 13*b*.

Figure 5:
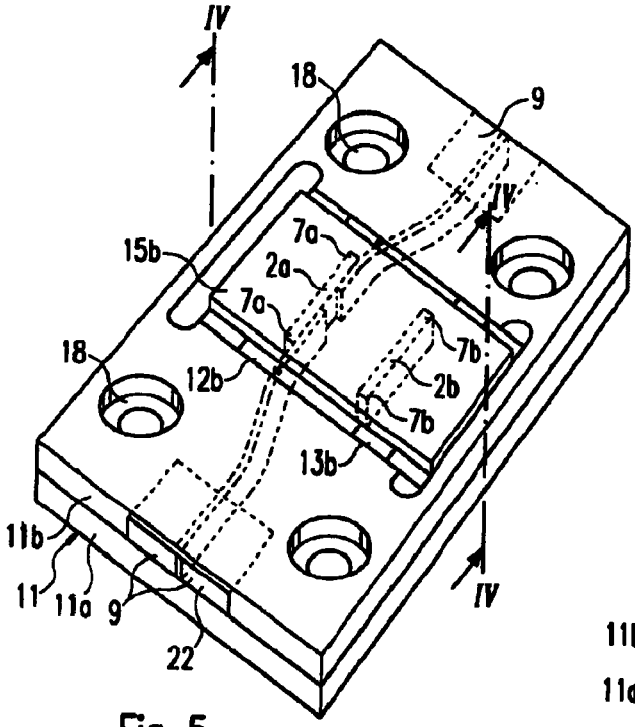
FIG. 5 shows a perspective view of a switching device according to the invention in a further modified embodiment.
Figure 6:
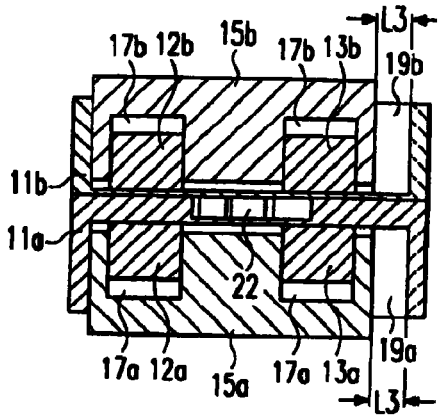
FIG. 6 shows the section VI-VI from FIG. 5.

In the exemplary embodiment shown in FIGS. 5 and 6, the adjustment magnets 12*a*, 12*b* and respectively 13*a*, 13*b* are disposed on slider components 15*a*, 15*b* arranged one above the other, wherein they can be at least partially countersunk in recesses 17*a*, 17*b* in the slider components 15*a*, 15*b*. A mechanical connection between the slider components 15*a*, 15*b* is present, but this is not illustrated in FIGS. 5 and 6. With this embodiment, the contact elements of the two switching devices 3 are protected in the interior chamber of a box formed by the slider components 15*a*, 15*b*. The interior chamber can be formed by a continuous longitudinal groove 22, which can be closed at the end respectively, for example, by the holder 9.

With this exemplary embodiment, the first base 11 provides a lower base component 11*a* and an upper base component 11*b*, which can be formed by plates disposed one above the other, which are screwed to one another by screws inserted in boreholes 18, which are not illustrated. In each case in mutually-matching central regions, the lower base component 11*a* and the upper base component 11*b* each provide an under-side recess and upper-side recess 19*a*, 19*b*, in which the slider components 15*a*, 15*b* are accommodated. In this context, at least two of the wall surfaces of the recesses 19*a*, 19*b* extending transversely to the electrical line 2 can form the guide, wherein the dimension of the recesses 19*a*, 19*b* also extending transversely is greater at least by the required length L3 of transverse movement than the associated transverse dimension of the slider components 15*a*, 15*b*, so that the adjustment magnets 12*a*, 12*b*, 13*a*, 13*b* and respectively the magnet pairs, can execute an sufficiently large transverse movement, in order to achieve the above-mentioned magnetic-force effects. The limiting surfaces of the recesses 19*a*, 19*b* offset transversely relative to the longitudinal central plane 14 can be arranged at such a distance from one another, that they form stops limiting the transverse movement of the magnets 12, 13 or the slider components 15*a*, 15*b*.

The electrical line 2 with the switching elements 4 can be disposed in the longitudinal groove 22 extending between the base components 11*a*, 11*b* or in one of the base components 15*a* (FIG. 5) or 15*b* (FIG. 6), of which the vertical dimension g is somewhat greater than the upright width d of the switching elements 4, in order to guarantee an adequate movement play for the latter. The holders 9 are arranged in end regions of the longitudinal groove 22, wherein the longitudinal groove itself can be disposed in the upper and/or lower base component 11*a*, 11*b*.

Figure 7:
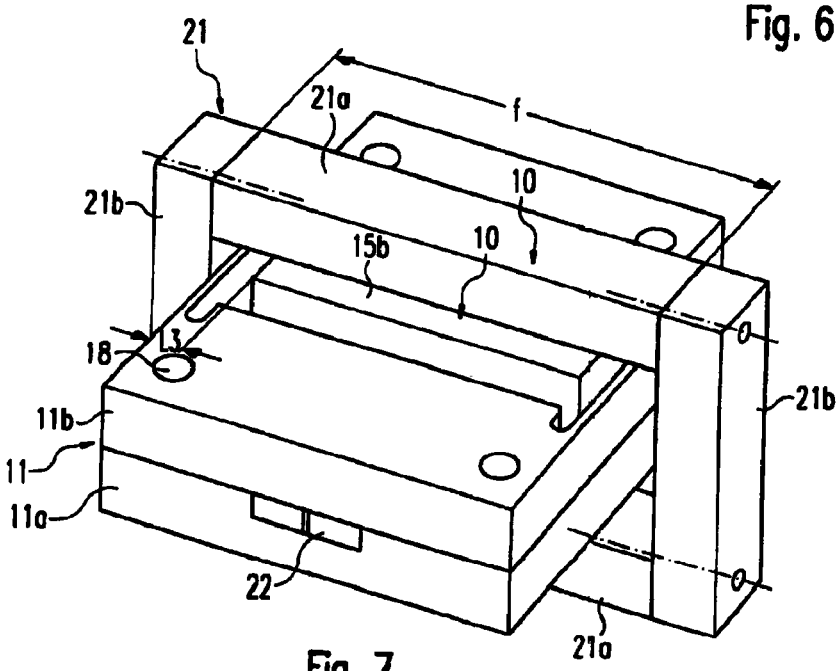
FIG. 7 shows a perspective plan view of another modified embodiment of the switching device according to the invention.

The exemplary embodiment according to FIG. 7 shows an advantageous design for the mechanical connection between the slider components 15*a*, 15*b*. This design provides a preferably-rectangular frame 21 engaging over the slider components 15*a*, 15*b* and the first base 11, which can consist of two horizontal and two vertical frame components, which can be screwed together. This is illustrated by sketched lines. The slider components 15*a*, 15*b* can be attached, for example, directly to the mutually-facing sides of the horizontal frame portions 21*a*. The transverse distance f between the vertical frame portions 21*b* is greater than the relevant transverse dimension of the base 11 at least by the length L3 of transverse movement, thereby guaranteeing a corresponding transverse movement L3 of the movement unit 10.

In order to mechanise the transverse movement of the adjustment magnets 12, 13 and/or the magnet pairs 12*a*, 12*b* and 13*a*, 13*b* or of the movement units 10 formed with the latter, it is advantageous to provide a respective transverse movement drive 23 with a preferably-electric drive motor 24, which can be, for example, an electromagnet 24*a*, which consists of a ferromagnetic core and an electric coil surrounding the latter. The drive motor or drive motors 24 can be supported, for example, on the base 11. In the exemplary embodiment according to FIGS. 8 to 11, in which the adjustment magnets 12*a*, 12*b*, 13*a*, 13*b* and the slider components 15*a*, 15*b* form the movement unit 10, one drive motor 24 is sufficient, in order to achieve the to and from movement of the movement unit 10. With an electromagnet 24*a*, this can be implemented in a first direction of movement via magnetic force and in the other transverse direction of movement by a restoring spring, which is not illustrated, or also by magnetic force after an electrical pole reversal of the electromagnet 24*a*. In the case of a magnetic transverse-movement drive 23, the core of the drive 24 is made of a ferromagnetic material and is used to hold the movement unit 10 by attracting the magnets 12, 13, 12*a*, 12*b*, 13*a*, 13*b*.

Figure 8:
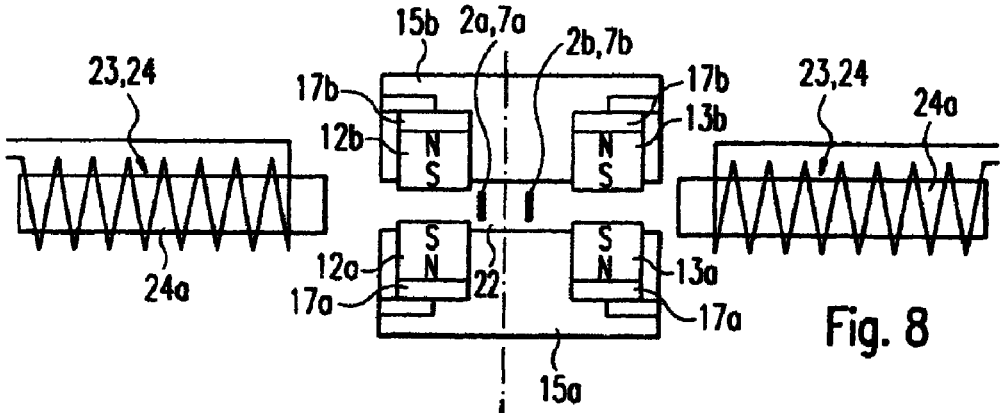
FIG. 8 shows a vertical cross-section of a modified embodiment of a switching device according to the invention in its two switching positions.
Figure 9:
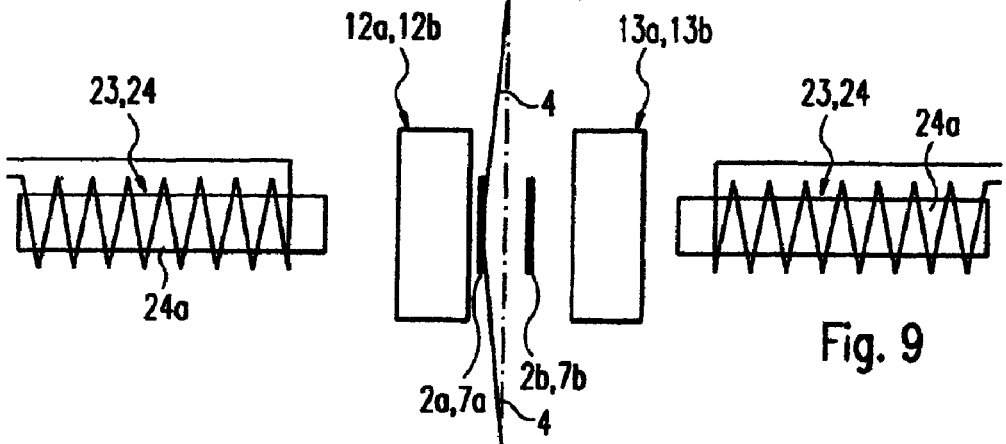
FIG. 9 shows the switching device according to FIG. 8 in plan view.
Figure 10:
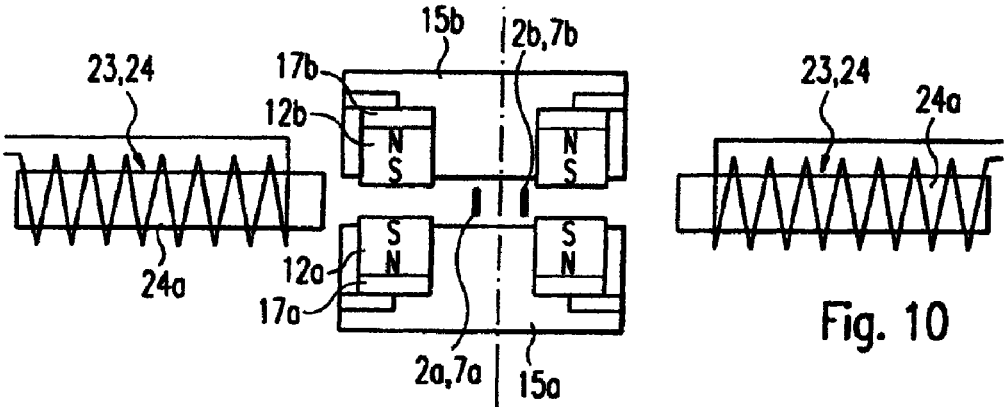
FIG. 10 shows the switching device according to FIG. 8 in its other switching position.
Figure 11:
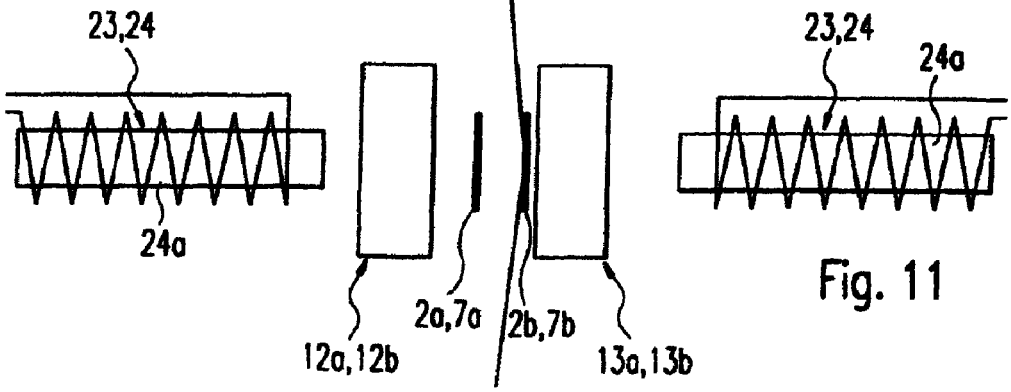
FIG. 11 shows a plan view of the switching device according to FIG. 10.

FIGS. 8 to 11 show two electromagnets 24*a* arranged on each side of the movement unit 10, which are electrically pole reversible and formed in such a manner that the one electromagnet acts by magnetic attraction and the other electromagnet acts by magnetic repulsion. For a transverse movement directed in the one direction or the other direction of movement, only a brief current impulse is required in order to supply the electromagnets with electrical energy and to implement the respective transverse movement. In FIGS. 8 and 9, the movement unit 10 is disposed in its end position moved towards the right, into which it has been moved by the right electromagnet 24*a* by magnetic attraction and by the left electromagnet 24*a* by magnetic repulsion. In this context, the switching elements 4 have been moved by the magnetic force of the left-hand magnetic pair 12*a*, 12*b* towards the left against the fixed-contact elements 7*a*, and they are held by the magnetic force in permanent contact with the fixed-contact elements 7*a*. The switching of the movement unit 10 into the switching position illustrated in FIGS. 10 and 11 is achieved correspondingly in reverse.

Figure 12:
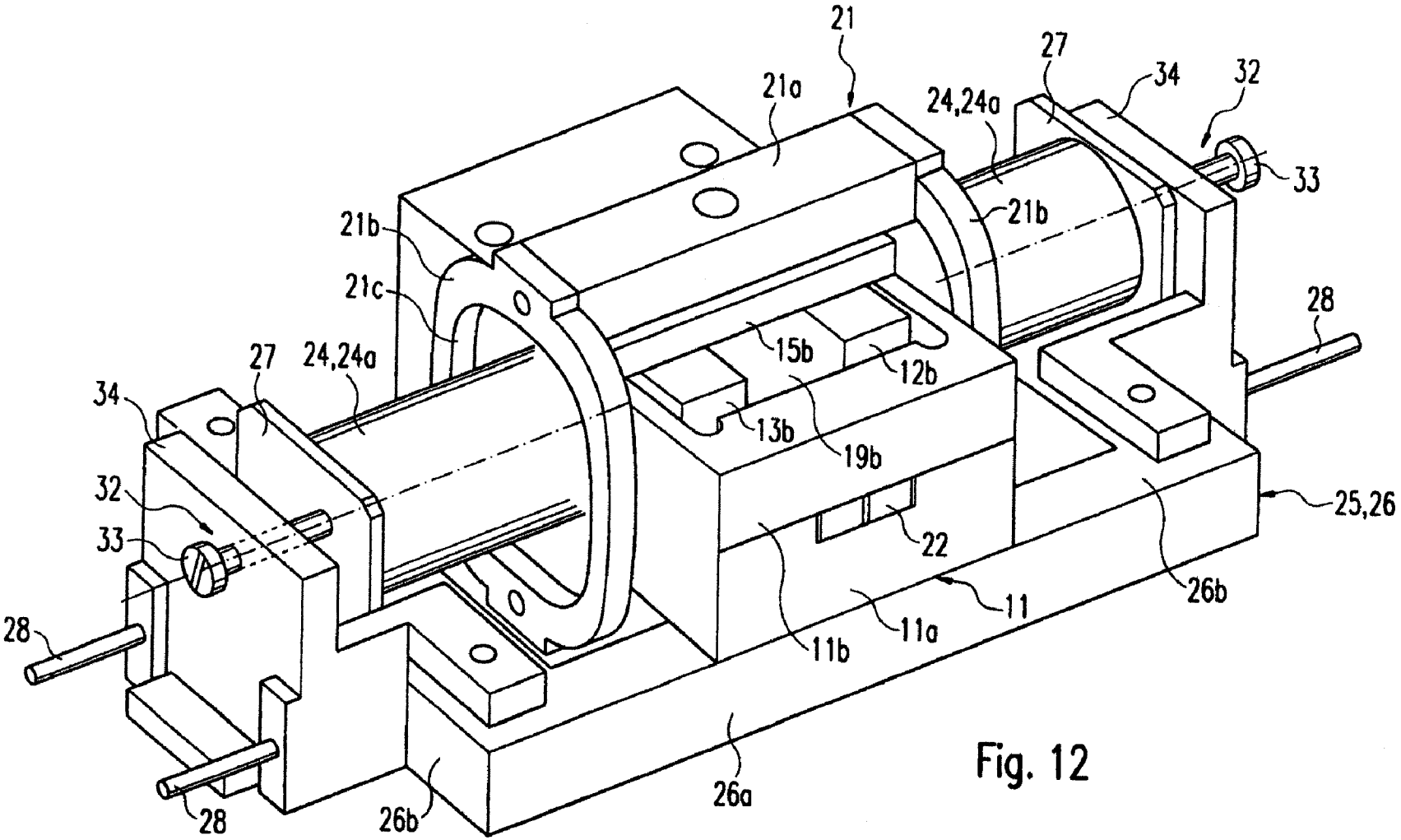
FIG. 12 shows another modified embodiment of a switching device according to the invention in perspective view.

The exemplary embodiment shown in FIG. 12 shows a perspective view of a design containing the basic embodiment shown in FIGS. 8 to 11, wherein, once again, the same components are indicated with the same reference numbers. The embodiment and arrangement of the switching device 1 according to FIG. 7 is integrated into the exemplary embodiment according to FIG. 12, however, with the difference that one or both lateral frame portions 21*b* is/are designed to be annular in shape, wherein the through passage 21*c* provided by the annular shape is larger, taking into consideration a movement play, than the cross-sectional size of the drive motor 24 or of the associated electromagnet 24*a*. As a result, the drive motor 24 or respectively the electromagnet 24*a* can extend up to the base or the base components 11*a*, 11*b*, so that the magnetic force can be better exploited. The annular shape of the frame portion or frame portions 21*b* also contributes to an improved exploitation of the magnetic force of the associated electromagnetic 24*a*.

Moreover, a second base 25 is provided, which bears the first base 11 and is preferably formed particularly by a rectangular frame 26, of which the transversely-extending frame portions 26*a* are connected to the longitudinal ends of the first base 11, and of which the longitudinally-extending frame portions 26 bear web components 27, which carry the associated drive motor or drive motors 24. In the exemplary embodiment, the first base 11 is mounted with its longitudinal ends on the transversely-extending frame portions 26*a*, and the drive motors 24 extend approximately horizontally from the internal sides of the web components 27. Connecting elements 28 for the power connection of the drive motor or drive motors 24 and/or electromagnets 24*a* can be attached directly or indirectly to the longitudinally-extending frame portions 26.

For the purpose of adjusting the electromagnetic efficacy, it is advantageous to arrange the electromagnets 24*a* to be displaceable transversely to and fro relative to the longitudinal central plane 14 in each case by means of an adjustment device 32. In the case of the exemplary embodiment, an adjustment screw 33 is provided for this purpose, which engages through a threaded borehole in an external web 34 projecting from the frame 26 and which also engages with its inner end region in a threaded borehole in the associated electromagnetic valve 24*a* or the internal web component 27.

Figure 13:
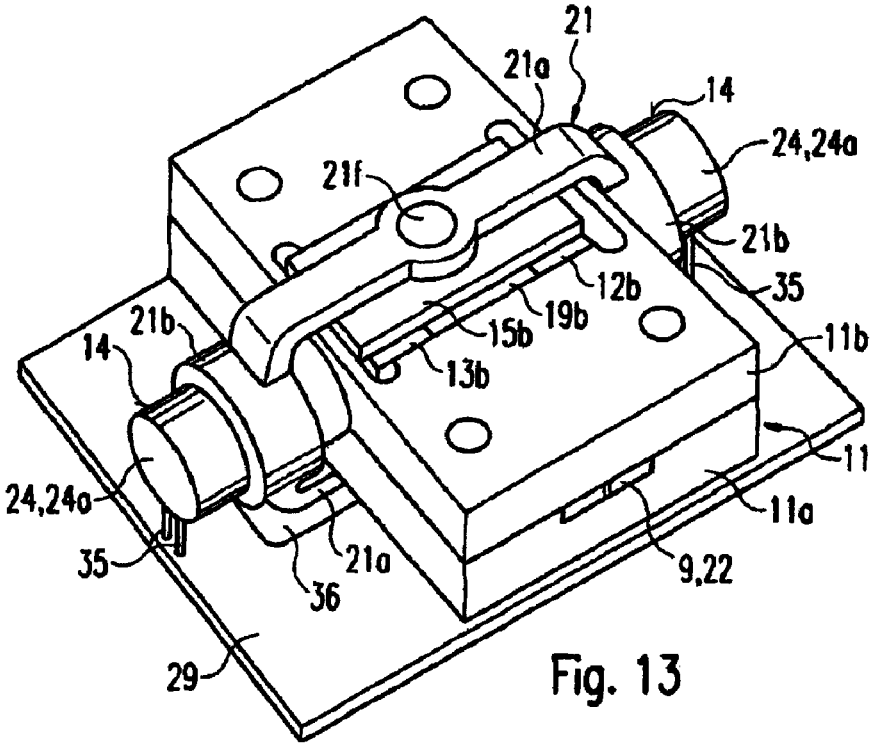
FIG. 13 shows another modified embodiment of a switching device according to the invention in perspective view.

FIG. 13 shows a perspective view of an exemplary embodiment similar to the previously-described exemplary embodiment. With this exemplary embodiment, the drive motors 24 or respectively electromagnets 24*a* form the transverse guide 14, wherein the annular frame portions 21*b* are mounted in a transversely-displaceable manner on the drive motors 24 or respectively electromagnets 24*a*. In this context, the switching-device unit designed in this manner can be arranged on a control device 29, for example, a printed-circuit board, and can be held by ribbon conductors 35 extending from the control board 29 to the drive motors 24 or respectively electromagnets 24*a*. With this embodiment, the frame portion 21*a* facing towards the control board 29 can be at least partially countersunk in a recess 36 of the control device 29, in order to reduce the structural height.

A central pin, for example, a round pin 21*f*, which engages in a pin recess in the slider components 15*a*, 15*b* can be provided in order to connect the slider components 15*a*, 15*b* to the frame portions 21*a*.

Figure 14:
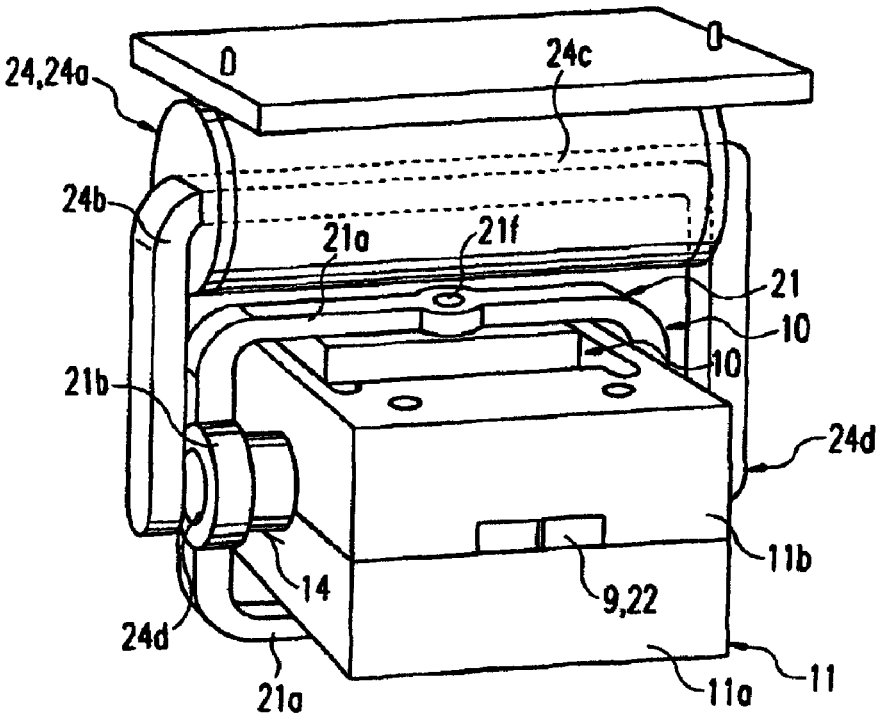
FIG. 14 shows another modified embodiment of a switching device according to the invention in perspective view.

The exemplary embodiment shown in FIG. 14 differs from the exemplary embodiment according to FIG. 13 in that only one drive motor 24 in the form of an electromagnet 24*a* is provided, of which the core 24*b* is designed in a c-shape, wherein the end portions 24*d* of the c-shape extend coaxially in the direction towards the movement unit 10 formed by the adjustment magnets 12, 13 or respectively the adjustment-magnet pairs 12*a*, 12*b*, 13*a*, 13*b*, the slider components 15*a*, 15*b* and the frame 21, and in this context engage over, and in the previously-described sense, form a transverse guide 14 for the frame portions 21*b* of the frame 21, which is displaceable on the latter. Only one coil 24*c* is provided, which surrounds a web portion of the c-shaped core 24*b*, preferably the web portion, which is offset transversely relative to the rotational plane 16 of the switching elements 4 and can be disposed, for example, above or below the switching device 1. With this embodiment, the control device 21 can form a further base component, to which the coil 24*c* is attached, either standing, suspended or transversely projecting, for example, on the ribbon conductors containing the associated electrical lines.

Figure 4:
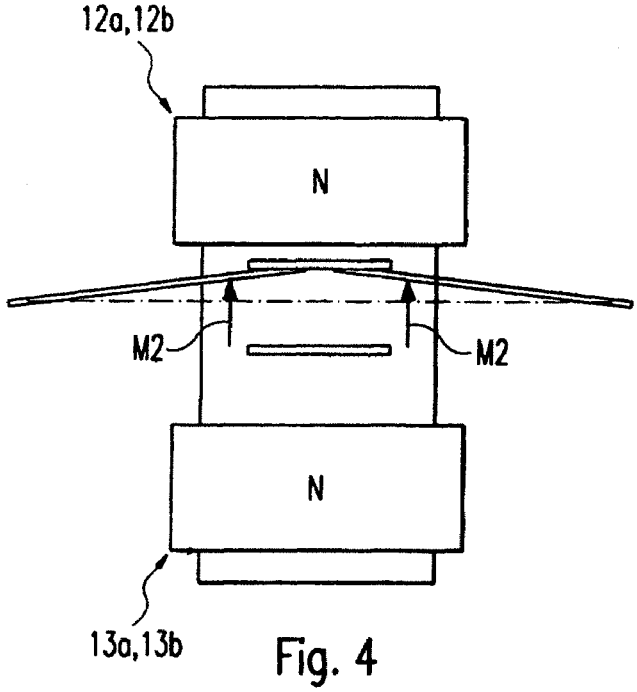
FIG. 4 shows a plan view of the switching device according to FIG. 3.

In particular, in the case of a calibration line, several pairs of switching devices 1 arranged respectively in mirror image with reference to the transverse plane 8 can be disposed along the calibration line arranged one after the other, as shown by way of example in FIG. 1 with two pairs of switching devices and in FIG. 4 with one pair of switching devices.

In this context, the respective switching element 4 can be a double switching element extending preferably in one piece beyond the holder or holders 9, which projects in both longitudinal directions from the holder 9, wherein the switching elements 4*a* facing away from one another cooperate with further movement drives and fixed-contact elements 7*a*, 7*b* of further calibration-line portions.

In order to protect the mutually-cooperating contact surfaces from external contamination, it is advantageous to arrange at least one switching device 1 in a protective chamber of a preferably-sealed housing, which can be designed in a longitudinal manner, in order to accommodate several switching devices 1 arranged in succession in a longitudinal direction, for example, as shown in FIG. 1.

The invention is not restricted to the exemplary embodiment presented. All of the elements described and illustrated can be combined with one another as required.

The invention claimed is:

1. Electrical switching device with at least one oblong electrical switching element having a broad side and a longitudinal direction and disposed with one contact end thereof between two fixed-contact elements transversely spaced from each other, and which switching element is movable by two adjustment elements transversely to said longitudinal direction of the switching element towards the one or the other fixed-contact element, wherein the adjustment elements are arranged laterally alongside the switching element and are movable transversely with respect to the longitudinal direction of the switching element to and from the switching element, wherein the switching element comprises magnetic material and the adjustment elements comprise magnets.

2. The switching device according to claim 1, wherein the magnets are permanent magnets.

3. The switching device according to claim 1, wherein the switching element is capable of resilient bending in a transverse direction.

4. The switching device according to claim 3, wherein the switching element comprises a resilient tongue having broad sides facing towards the fixed-contact elements.

5. The switching device according to claim 1, wherein the magnets are disposed on the sides of fixed-contact elements facing away from the switching element.

6. The switching device according to claim 5, wherein the magnets project beyond the fixed-contact elements towards the base of the switching element.

7. The switching device according to claim 1 comprising two switching elements disposed opposite to one another with reference to a transverse plane and movable transversely with mutually-facing contact ends thereof towards fixed-contact elements arranged on both sides thereof, and magnets disposed laterally opposite to one another assigned to both switching elements.

8. The switching element according to claim 7, wherein one magnet overlaps the mutually-facing ends of the switching elements, and is disposed on each side of the switching elements.

9. The switching device according to claim 1 wherein a longitudinal dimension of the magnets directed along the switching element or switching elements is greater than a transverse dimension of the magnets.

10. The switching device according to claim 1, wherein the magnets can be moved respectively in the same transverse direction at the same time.

11. The switching device according to claim 10, wherein the magnets are connected to one another by a coupling element.

12. The switching device according to claim 10, wherein the magnets are held on a transverse slider.

13. The switching device according to claim 1, comprising two magnets arranged with reference to a plane of movement of the switching element or the switching elements at a distance from one another with the same poles or the magnets arranged opposite to one another, and disposed on each side of the switching element or the switching elements.

14. The switching device according to claim 13, wherein the distance is approximately equal to or greater than a width of the switching element or switching elements.

15. The switching device according to claim 13, wherein the magnets arranged on both sides of the plane of movement of the switching element are disposed respectively on sides facing towards the plane of movement of two slider components, wherein the slider components are connected to one another to form a movement unit, of which lengths of movement are limited.

16. The switching device according to claim 15, wherein the slider components are each arranged in recesses facing away from one another of a first base and are mounted to be displaceable in the transverse direction.

17. The switching device according to claim 16, wherein the slider components are connected to one another by a frame surrounding the base.

18. The switching device according to claim 1, wherein the magnets arranged on both sides of the switching element can each be moved transversely by a drive motor.

19. The switching device according to claim 18, wherein the drive motor is formed by an electromagnet.

20. The switching device according to claim 19 wherein one or two electromagnets are disposed with a lateral offset relative to the switching element or switching elements.

21. The switching device according to claim 20, wherein the electromagnet or the electromagnets are pole-reversible.

22. The switching device according to claim 18, wherein the drive motors engage in through-passages through annular-shaped frame portions of the frame.

23. The switching device according to claim 1, comprising one or more switching devices or switching-device pairs disposed in succession in the longitudinal direction and arranged in a protective chamber of a housing.

* * * * *